US010837708B2

(12) United States Patent
Maucher et al.

(10) Patent No.: US 10,837,708 B2
(45) Date of Patent: Nov. 17, 2020

(54) PLATE TYPE HEAT EXCHANGER FOR EXHAUST GAS

(71) Applicant: MAHLE International GmbH, Stuttgart (DE)

(72) Inventors: Ulrich Maucher, Korntal-Münchingen (DE); Jürgen Barwig, Vaihingen/Enz (DE); Steffen Ensminger, Notzingen (DE); Eberhard Pantow, Winnenden (DE); Claudia Lang, Abstatt (DE); Timo Peifer, Stuttgart (DE); Matthias Schmid, Stuttgart (DE); Jürgen Steimer, Esslingen (DE)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 394 days.

(21) Appl. No.: 14/860,837

(22) Filed: Sep. 22, 2015

(65) Prior Publication Data

US 2016/0084583 A1 Mar. 24, 2016

(30) Foreign Application Priority Data

Sep. 22, 2014 (DE) ..... 10 2014 219 093

(51) Int. Cl.
*F28F 9/02* (2006.01)
*F28D 1/00* (2006.01)
(Continued)

(52) U.S. Cl.
CPC ..... *F28D 7/1661* (2013.01); *F02M 25/0737* (2013.01); *F28D 7/1684* (2013.01);
(Continued)

(58) Field of Classification Search
CPC ..... F28D 15/06; F28D 9/0031; F28D 9/0037; F28D 7/1684; F28F 9/0221; F28F 1/006
(Continued)

(56) References Cited

U.S. PATENT DOCUMENTS 3,847,211 A * 11/1974 Fischel ..... B01D 53/22 165/166
4,745,967 A * 5/1988 Kern ..... F25B 39/02 165/150
(Continued)

FOREIGN PATENT DOCUMENTS

DE 100 24 389 A1 11/2000
DE 101 03 570 A1 8/2002
(Continued)

OTHER PUBLICATIONS

Translation of French Patent Document WO 2012080039 A2 entitled Translation—WO 2012080039 A2.*
(Continued)

*Primary Examiner* — Paul Alvare
(74) *Attorney, Agent, or Firm* — Paul D. Strain, Esq.; Strain & Strain PLLC

(57) ABSTRACT

A heat exchanger, in particular exhaust-gas cooler, is described herein. The heat exchanger includes tubes of unipartite form or formed from two plates. The tubes form a first and a second fluid duct, and the respective fluid ducts are arranged adjacent to one another. The first fluid duct is designed to be open at at least one of its ends for the inflow and/or outflow of a first fluid. The second fluid ducts are closed at an end side of the tubes by way of an inward or outward step. The step has a greater extent T in the tube longitudinal direction in the corner regions of the tube than between the corner regions. Several non-limiting descriptive embodiments are disclosed herein.

5 Claims, 3 Drawing Sheets

(51) Int. Cl.

| | |
|---|---|
| ***F28D 7/16*** | (2006.01) |
| ***F28D 9/00*** | (2006.01) |
| ***F28F 1/04*** | (2006.01) |
| ***F28F 1/02*** | (2006.01) |
| ***F02M 25/07*** | (2006.01) |

(52) U.S. Cl.
CPC ..... *F28D 9/0031* (2013.01); *F28D 9/0037* (2013.01); *F28F 1/025* (2013.01); *F28F 1/045* (2013.01); *F28F 9/0221* (2013.01)

(58) Field of Classification Search
USPC ..... 165/149, 158, 906
See application file for complete search history.

(56) References Cited

U.S. PATENT DOCUMENTS

| | | | | |
|---|---|---|---|---|
| 5,915,472 | A * | 6/1999 | Takikawa | F28D 7/1607 165/158 |
| 2005/0161206 | A1* | 7/2005 | Ambros | F02B 29/0462 165/173 |
| 2006/0011333 | A1* | 1/2006 | Emrich | F28D 9/0043 165/167 |
| 2006/0201663 | A1* | 9/2006 | Strahle | F28D 9/0031 165/164 |
| 2006/0207245 | A1* | 9/2006 | Yamaguchi | F01N 5/02 60/320 |
| 2006/0219394 | A1* | 10/2006 | Martin | F28D 9/0043 165/157 |
| 2008/0202735 | A1* | 8/2008 | Geskes | F28D 9/0006 165/166 |
| 2010/0006274 | A1* | 1/2010 | Cho | F28D 9/0037 165/166 |
| 2012/0325445 | A1* | 12/2012 | Dinulescu | B21D 51/52 165/166 |
| 2015/0184946 | A1 | 7/2015 | Barwig et al. | |

FOREIGN PATENT DOCUMENTS

| | | | | |
|---|---|---|---|---|
| DE | 10 2005 034 137 | A1 | 1/2007 | |
| DE | 10 2013 218 444 | A1 | 3/2014 | |
| EP | 1 227 291 | A2 | 7/2002 | |
| JP | 2007046890 | A * | 2/2007 | F28D 7/16 |
| JP | 2007-225190 | A | 9/2007 | |
| JP | 2011-43257 | A | 3/2011 | |
| WO | WO 2012/080039 | A2 | 6/2012 | |
| WO | WO 2012080039 | A2 * | 6/2012 | F28D 9/0037 |
| WO | WO 2014/040797 | A1 | 3/2014 | |

OTHER PUBLICATIONS

German Search Report, Application No. DE 10 2014 219 093.2, dated Jul. 6, 2015, 8 pgs.

* cited by examiner

PLATE TYPE HEAT EXCHANGER FOR EXHAUST GAS

CROSS-REFERENCE TO RELATED PATENT APPLICATIONS

This application is based upon and claims the benefit of priority from prior German Patent Application No. 10 2014 219 093.2, filed Sep. 22, 2014, the entire contents of which are incorporated herein by reference in their entirety.

TECHNICAL FIELD

The invention relates to a heat exchanger, in particular a charge-air cooler or an exhaust-gas cooler for a motor vehicle, as per the embodiments disclosed herein.

PRIOR ART

Exhaust-gas coolers have the task of cooling hot exhaust gas of internal combustion engines in order that said cooled exhaust gas can be admixed to the intake air again. In this case, to increase the thermodynamic efficiency of an internal combustion engine, cooling to a very low level is sought. This principle is generally known as cooled exhaust-gas recirculation, and is used to achieve a reduction of pollutants, such as in particular nitrogen oxides, in the exhaust gas.

DE 100 24 389 A1, DE 10 2005 034 137 A1 and WO 2014/040797 A1 have disclosed such heat exchangers, which are formed from a stack of plate pairs, wherein a first flow duct is formed between a pair of plates, and a second flow duct is formed between two plate pairs stacked one on top of the other.

In this case, the first flow duct is normally closed off to the outside and fluidically connectable to a fluid duct, for the admission of a first fluid into and discharge of a first fluid out of the first flow duct, only via inflow and outflow openings in the stack or on a housing surrounding the stack. In this case, the first fluid is normally a cooling fluid such as, for example, cooling water.

The second flow duct is likewise normally of open form at its narrow side, in order, for example via a provided connector element, for a second fluid to be distributed to or discharged from the multiplicity of second flow ducts which are arranged adjacent to one another in stacked fashion. Here, as second fluid, use is made of a gas such as air, exhaust gas or an exhaust gas-air mixture.

In the case of such heat exchangers, the inflowing second fluid is generally very hot, such that the front edge of the plate pairs at the inflow side at which the second fluid enters the heat exchanger is subject to very high thermal stress.

The temperature transition from the very hot, non-cooled gas inlet region of the second flow duct to that region of the heat exchanger which is connected to the coolant leads to high stresses owing to the different thermal expansion owing to the different temperatures.

Furthermore, in the inlet region for the hot gas, the gas is generally guided using relatively thick-walled diffusers in order to be able to withstand the high pressures and temperatures, wherein the heat-exchanging plates of the heat exchanger are designed with the thinnest walls possible for reasons of efficiency, cost and weight. Owing to the different prevailing temperatures, the diffuser and the plates expand to different extents, resulting in high stresses in the relatively thin-walled plates of the plate stack, in particular in the corners of the plates at the hot-gas inlet.

Normally, the plates or the plate pairs are inserted into a tube sheet of the heat exchanger, which is connected to a housing and/or to the gas inlet diffuser. The tube sheet is normally designed with thicker walls than the plates themselves, such that the risk of failure as a result of thermal stresses in the transition region to the hot diffuser is thereby reduced.

For reasons relating to cost, weight and the manufacturing process, however, it is increasingly sought to dispense with a tube sheet and to realize the sealing of the flow ducts, formed as coolant ducts, between a plate pair by way of suitable shaping of the plates. The plates or the tubes are then connected directly to the thicker-walled housing of the heat exchanger. Thermal stresses originating from the hot diffuser then act directly on the thin-walled plates. In this case, the flow ducts for the hot gas, such as the charge air or the exhaust gas, are flared at the ends such that in each case two gas ducts situated one on top of the other lie against one another at the ends, but otherwise a gap remains between the tubes for the guidance of coolant. In the case of such concepts, thermal deformations are reduced, as the diffuser is connected to the housing. Nevertheless, further measures may be necessary for reducing the thermal stresses in the plate corners, because these are particularly susceptible to thermally induced stresses.

PRESENTATION OF THE INVENTION, PROBLEM, SOLUTION, ADVANTAGES

It is the object of the invention to provide a heat exchanger which is formed without a tube sheet, wherein the plate pairs that form the flow ducts are improved in relation to the prior art such that thermally induced stresses are reduced, and a longer service life is thus achieved.

This is achieved by means of the features of the embodiments of the application disclosed herein.

An exemplary embodiment of the invention relates to a heat exchanger, in particular exhaust-gas cooler, having tubes of unipartite form or formed from two shell-like plates, which tubes form a first and a second fluid duct, wherein the respective fluid ducts are arranged adjacent to one another, wherein the first fluid duct is designed to be open at at least one of its ends for the inflow and/or outflow of the first fluid, wherein, at the ends, the tubes are, by way of an inward or outward step, designed such that the second fluid ducts are closed at the end side, wherein the step has a greater extent T in the tube longitudinal direction in the corner regions of the tube than between the corner regions.

In this way, at the front edge of the plate pair, where the hot second fluid flows in, a flat front edge is formed in which there is preferably no or only little first fluid arranged on the inner side, such that the risk of boiling there is reduced. It is only further onward as viewed in the longitudinal direction that the first fluid duct increases in height, at a location where the plate pair of the fluid duct is however preferably already laterally in contact with the housing or the diffuser, such that there, the risk of boiling has already reduced owing to better heat dissipation.

It is also advantageous if the tube has a tube long side and a tube narrow side, wherein, at at least one tube end, the step is provided in the tube wide side or in the tube narrow side or on the tube narrow side and on the tube long side.

It is furthermore also advantageous if the first fluid duct is of approximately U-shaped cross section with an inward step or H-shaped cross section with an outward step.

Here, it is advantageous if the first fluid duct is of approximately U-shaped or H-shaped cross section. If the first fluid duct is of approximately U-shaped form, the outer wall of the plate stack can advantageously be formed by fluid ducts for a first fluid as coolant, which gives rise to an outer wall at relatively low temperature. The same can also be provided using H-shaped fluid ducts. However, if the first fluid duct is of approximately H-shaped form, the outer wall of the plate stack may also be formed by fluid ducts for a second fluid, as a fluid to be cooled, in order to realize large cross sections for the second fluid.

It is also advantageous if the step is formed, by stamping, into one and/or into the other of the two plates. In this way, the step can be realized by stamping. The step is preferably stamped, by way of stamped formations, into one of the two plates, wherein the other plate is of substantially planar form. This facilitates the production and the connection of the two plates, because then, the stepped region of one plate can be simply placed onto the other, substantially flat plate.

It is also advantageous if the step has, at the transition from the bottom to the side walls, a rounded widening of the edge region of relatively low height, or in the case of an outward step, a relatively large height. In this way, the relatively flat region in the corner in the transition from the bottom to the side wall is enlarged in the longitudinal direction, which reduces possible thermal stresses.

Here, it is particularly expedient if the rounded widening is formed in the bottom such that the dimension, measured along the long side, of the edge region of relatively low height decreases in the direction of the middle of the fluid duct proceeding from the side wall. In this way, a continuous transition is realized, which reduces the stresses and at the same time keeps the risk of boiling relatively low.

Here, it is particularly advantageous if the dimension of the rounded widening decreases in arcuate fashion. This also reduces the stresses in the corner region of the fluid duct or of the plates.

It is particularly advantageous if the dimension of the rounded widening decreases in S-shaped fashion.

It is particularly advantageous if the rounded widening also extends into at least one side wall, preferably into both side walls. In this way, the transition from the bottom to the side wall in the region of the corner is improved with regard to the occurring stresses, and the stresses in the material of the plate are reduced.

It is also advantageous if the rounded widening is formed in a side wall such that the dimension of the edge region of relatively low height in the longitudinal direction of the flow duct decreases in the direction of the middle of the height of the side wall proceeding from the bottom. In this way, the clear inner width of the fluid duct at the side wall is reduced by the rounded region only over a part of the height.

It is also expedient if the dimension of the rounded widening decreases in arcuate fashion. It is thus also advantageous if the dimension of the rounded widening decreases in S-shaped fashion.

Further advantageous refinements are described in the following description of the figures and by the subclaims.

BRIEF DESCRIPTION OF THE DRAWINGS

Below, the invention will be discussed in more detail on the basis of at least one exemplary embodiment and with reference to the drawings. In the drawings.

PREFERRED EMBODIMENT OF THE INVENTION

Figure 1:
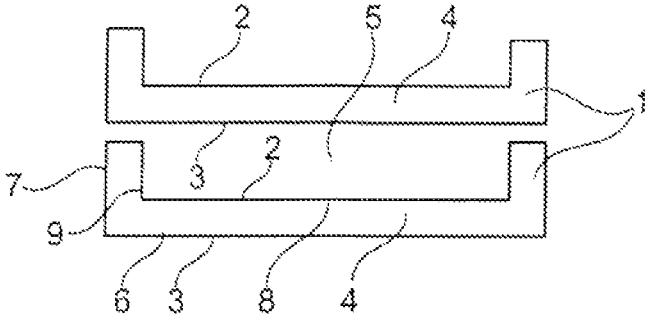
FIG. 1 shows a schematic view of two plate pairs stacked one on top of the other.

FIG. 1 shows a schematic arrangement of two plate pairs 1 which are each formed from a first plate 2 and a second plate 3 and which form a first fluid duct 4 for a first fluid between the plates 2, 3, wherein a second fluid duct 5 for a second fluid is formed between respectively adjacent plate pairs 1. Here, the plates 2, 3 preferably have a substantially planar bottom 6, 8, and side walls 7, 9 which project from said bottom. The respective plates 2, 3 of a plate pair 1 are placed one on top of the other and are connected to one another in fluid-tight fashion, for example by brazing, at their edge in order to form the sealed fluid duct. Either on one of the side walls 7, 9 or on both side walls 7, 9 and/or on the bottom 6, 8, there are provided openings (not illustrated) for the admission of the first fluid into the first fluid duct 4 or for the discharge of said first fluid out of the first fluid duct 4 again. The second fluid ducts 5 are normally designed to be open at their end sides in order that flow can enter them substantially frontally.

The plate pairs 1 are of U-shaped form in section, such that the first flow duct 4 extends not only in a plane of the bottom 6, 8 but also in the vertical direction along the plane of the side walls 7, 9. In this way, the stack of plate pairs 1 is delimited laterally by walls of the first fluid duct 4, which walls may be cooled outer walls in the case of a fluid duct 4 which conducts cooling fluid. In this way, the heat exchanger is not so hot on the outside, which is favorable with regard to the installation of the heat exchanger.

Figure 2:
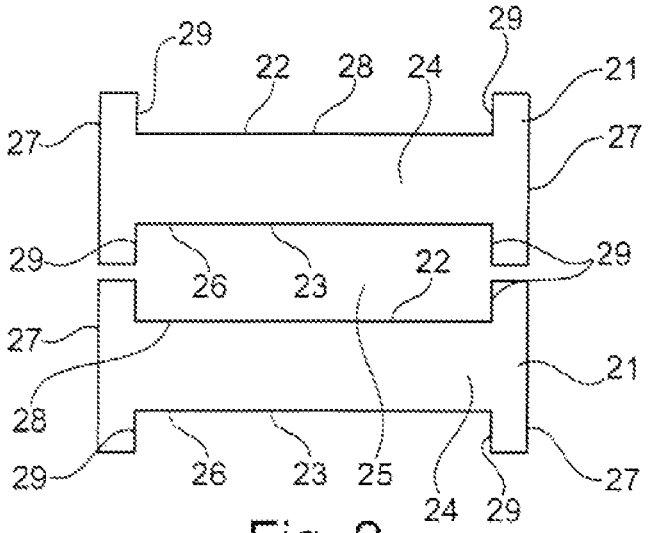
FIG. 2 shows a schematic view of two alternative plate pairs stacked one on top of the other.

FIG. 2 shows a schematic arrangement of two other plate pairs 21 which are each formed from a first plate 22 and a second plate 23 and which form a first fluid duct 24 for a first fluid between the plates 22, 23, wherein a second fluid duct 25 for a second fluid is formed between respectively adjacent plate pairs 21.

Here, the plates 22, 23 preferably have a substantially planar bottom 26, 28, and side walls 27, 29 which project from said bottom. The respective plates 22, 23 of a plate pair 1 are placed one on top of the other and are connected to one another in fluid-tight fashion, for example by brazing, at their edge in order to form the sealed fluid duct 24.

For the purposes of supply and/or discharge, openings (not illustrated) are provided on one of the side walls 27, 29 or on both side walls 27, 29 and/or on the bottom 26, 28. The second fluid ducts 25 are normally designed to be open at their end sides in order that flow can enter them substantially frontally.

It may however alternatively also be provided that, for the supply and/or discharge of the second fluid in the second fluid duct 25, openings (not illustrated) are provided on one of the side walls 27, 29 or on both side walls 27, 29 and/or on the bottom 26, 28. The first fluid ducts 24 are then correspondingly designed to be open at their end sides in order that the first fluid can flow into them substantially frontally.

The plate pairs 21 are of H-shaped form in section, such that the first flow duct 24 extends not only in a plane of the bottom 26, 28 but also in the vertical direction along the plane of the side walls 27, 29, specifically in both the upward and downward vertical directions proceeding from the bottom.

From such plate pairs 1, 21 shown for example in FIG. 1 or 2, it is possible, by stacking these one on top of the other, to produce a bundle or a stack of plate pairs, by means of which a heat exchanger is produced. The heat exchanger, which is in particular in the form of an exhaust-gas cooler or charge-air cooler, preferably comprises a plate stack composed of multiple elongate plate pairs, wherein the plate pairs have a long side and a narrow side, wherein in each case two interconnected plates form a first, in particular elongate, fluid duct between them, and in each case one second, in particular elongate, fluid duct is formed between two plate pairs.

In this case, the longitudinal direction or the long side defines the direction or side between two openings as inlet and outlet for a fluid, said openings being formed at the narrow sides, also referred to as end sides. It is nevertheless possible for the extent in the longitudinal direction to be longer, equal to or shorter than the extent of the narrow side.

Figure 5:
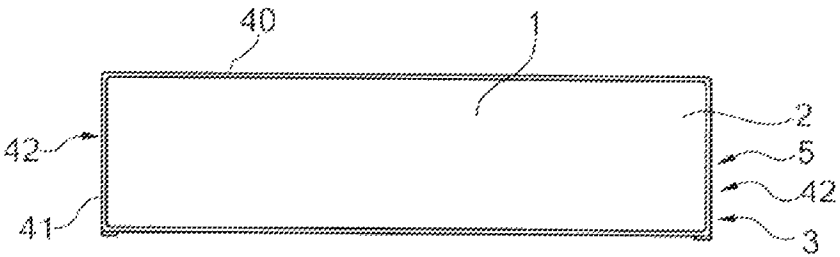
FIG. 5 shows a plate pair in a plan view.

FIG. 5 shows such an elongate plate pair 1 in a plan view from above. It is possible to see the elongate form of the plate pair 1, and thus also the elongate form of the individual plates 2, 3, which have a long side 40 and a narrow side 41, wherein the inflow sides for the second fluid ducts 5 are normally formed on the narrow side, whereas the inlets and outlets (not illustrated) of the first fluid ducts may also be arranged laterally or above and/or below. Here, it may also be provided that the long side 40 is shorter than the narrow side 41. Flow passes through in the direction of the long side, that is to say in the longitudinal direction, wherein the inlets and outlets are arranged at the narrow sides.

Figure 3:
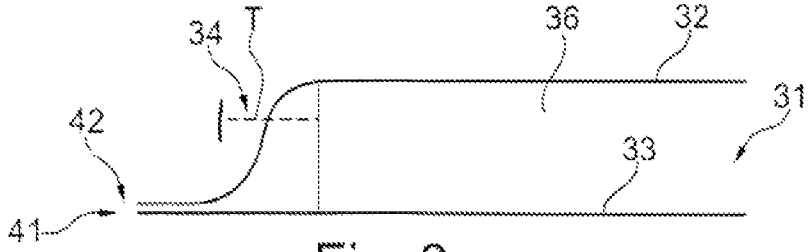
FIG. 3 is an illustration of a front edge of a plate pair in section.
Figure 4:
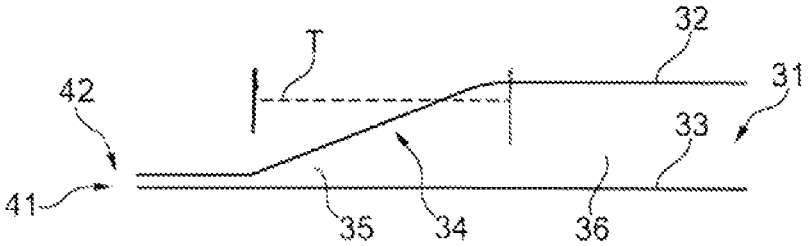
FIG. 4 is an illustration of a front edge of a plate pair in section.

FIGS. 3 and 4 each show an exemplary embodiment of a front edge 42 of a plate pair 31 in the region of the narrow side 41 of the plate pair 31. In this case, the upper plate 32 is placed onto the lower plate 33, and the two plates 32, 33 form a step 34 at the front edge. Said step 34 is, as per FIG. 3, of S-shaped form, wherein the depth T is smaller than in the exemplary embodiment of FIG. 4. In the exemplary embodiment of FIG. 4, the front end 35 of the fluid duct 36 is of relatively pointed and long form, which locally increases the risk of boiling.

Figure 7:
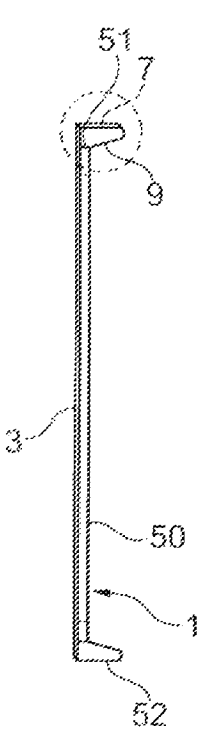
FIG. 7 is a sectional illustration of the plate pair as per FIG. 6.
Figure 6:
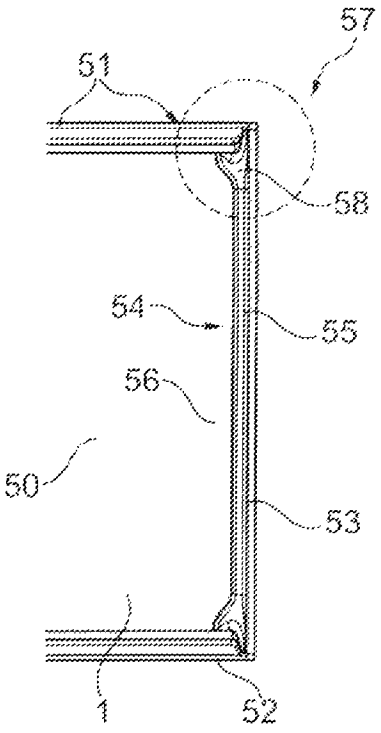
FIG. 6 shows an enlarged view of a plate pair as per FIG. 5 in the region of the front edge.

FIG. 6 shows an enlarged view of the plate pair 1 as per FIG. 5, and FIG. 7 shows a section through the plate pair 1 as per FIG. 5. The plate pair 1 is designed so as to have a bottom 50 and side walls 51, 52 which project laterally from said bottom, wherein both the bottom 50 and the side walls 51, 52 are each of double-walled form. In this case, each of the plates 2, 3 has a substantially flat bottom 6, 8 and two side walls 7, 9 which, as a double-walled structure, form the plate pair 1.

At the front edge 53, that is to say at the front edge of the narrow side, the plate pair 1 is formed with a step 54 as a transition from one plate 2 to the other plate 3, wherein the transition forms an edge region 55 of relatively low height h and a further region 56 of relatively large height H, wherein the region 56 adjoins the region 55.

Here, the edge region 55 of relatively low height is formed with a rounded widening 58 in the corner regions 57 between the front edge 53 and the side walls 51, 52.

Here, the step 54 is advantageously stamped, by way of stamped formations, into one and/or into the other of the two plates 2, 3. FIGS. 3 and 4 show that the step 54 is stamped, by way of stamped formations, into only one of the two plates, for example the upper plate, wherein the other plate, for example the lower plate, is of substantially planar form. It is however alternatively also possible for the step to be formed into the other plate, for example the lower plate, wherein then, the other plate, for example the upper plate, is planar. It is also alternatively possible for the stamped formations to be formed into each of the two plates 2, 3.

Figure 8:
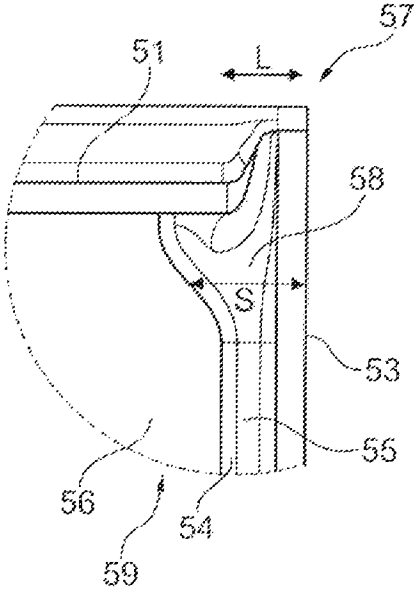
FIG. 8 is an enlarged illustration of a corner region of a plate pair.

FIG. 8 shows the corner region in FIG. 6 in an enlarged illustration. It can be seen that the edge region 55 has, in the transition from the bottom to the side walls, a rounded widening 58 of the edge region 55 of relatively low height. Said widening 58 is formed in the bottom such that the dimension s, measured along the long side L, of the edge region 55 of relatively low height decreases in the direction of the middle 59 of the fluid duct proceeding from the side wall. Here, it can also be seen that the dimensions of the rounded widening 58 decreases in arcuate or S-shaped fashion.

In this case, the widening 58 ends at the corner at the transition to the side walls.

Figure 9:
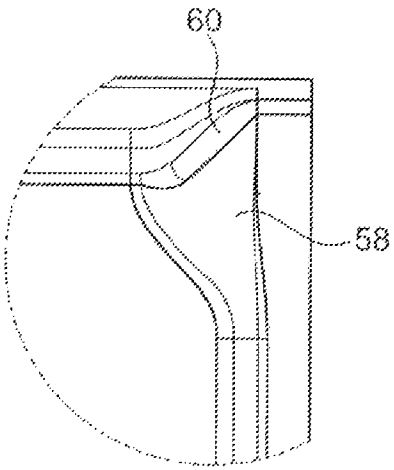
FIG. 9 is an enlarged illustration of a corner region of a plate pair.
Figure 11:
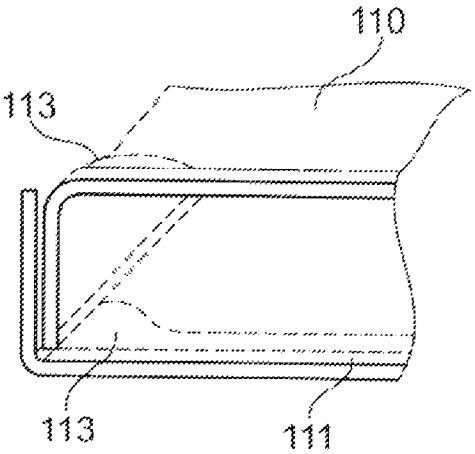
FIG. 11 is an illustration of a corner region of a tube with a step which is widened in the corner.

FIG. 9 shows that the rounded widening 58 of the bottom also extends into at least one side wall 51 and preferably also into both side walls 51. The widening in the side wall 51 is in this case denoted by 60.

Here, the rounded widening 60 is formed in a side wall 51 such that the dimension of the edge region 51 of relatively low height in the longitudinal direction L of the fluid duct decreases in the direction of the middle of the height of the side wall 51 proceeding from the bottom. Here, the dimension of the rounded widening 60 likewise advantageously decreases in arcuate or S-shaped form.

Figure 10:
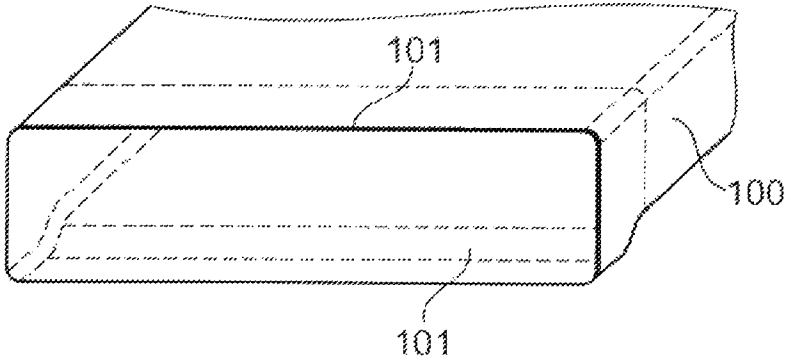
FIG. 10 is an illustration of a tube with a step which is uniform over the width.
Figure 12:
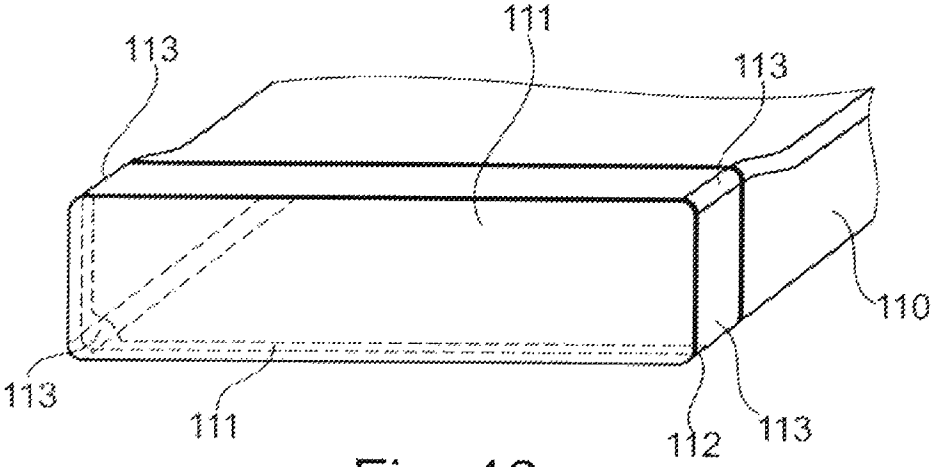
FIG. 12 is an illustration of a tube with an in each case widened step in the corners.

FIGS. 10 and 12 each show tubes with their end regions, wherein the tube 100 of FIG. 10 exhibits a step 101 which is uniform over the width of the tube 100. FIG. 12 shows a tube 110 which has a step 111, wherein the step 111 is deeper, that is to say extends further inward in the longitudinal direction of the tube 110, in the corners 112 than between the corners 112. The step 113 in the corner thus forms a type of arc in order to realize a transition from the depth of the step in the corner to the depth of the step in the region between the corners 112.

The invention claimed is:

1. A heat exchanger comprising:

a plurality of tubes having a top side and a bottom side, wherein the tubes are formed from two plates, wherein each plate of the two plates forms either the top side or the bottom side, a plurality of first fluid ducts for a first fluid, wherein each tube bounds a first fluid duct of the plurality of first fluid ducts, a plurality of second fluid ducts, wherein a pair of adjacent tubes bounds a second fluid duct of the plurality of second fluid ducts such that the first and second fluid ducts are arranged adjacent to one another, wherein the second fluid duct is open at a front side and a back side for an inflow and outflow of a second fluid, wherein each tube has two opposite side walls perpendicular to a front edge and a back edge which are distinct from the top side and bottom side of the two plates, at least one tube end of each tube comprises a step, wherein the step comprises a transition between a region of relatively low height closer to the front edge and a region of relatively large height closer to the back edge, wherein the region of relatively low height has a shorter distance between the top side and bottom side compared to the region of relatively large height, wherein a distance between the top side and the bottom side increases in the step, wherein the distance increases towards the back edge, wherein the region of relatively low height has a rounded widening, wherein the rounded widening is positioned in a transition from a bottom wall to one side wall of the two opposite side walls and the rounded widening ends at the transition to the one side wall, wherein the rounded widening has a width dimension being perpendicular from the front edge, wherein the width dimension decreases in a direction of a middle region of the first fluid duct proceeding from the one side wall, wherein the heat exchanger does not comprise a tube sheet, wherein the width dimension of the rounded widening decreases in S-shaped fashion.

2. The heat exchanger according to claim 1, wherein each tube has a tube long side and a tube narrow side, wherein the tube long side has a greater length than the tube narrow side, wherein the step is arranged in the tube narrow side.

3. The heat exchanger according to claim 1, wherein the first fluid duct comprises a U-shaped cross section with an inward step or H-shaped cross section with an outward step.

4. The heat exchanger according to claim 1, wherein the tubes are formed from two plates, wherein the step is stamped, by way of stamped formations, into one or both of the two plates.

5. The heat exchanger according to claim 4, wherein the step is stamped, by way of stamped formations, into only one of the two plates.

* * * * *